US010815766B2

(12) United States Patent
Potapenko et al.

(10) Patent No.: US 10,815,766 B2
(45) Date of Patent: Oct. 27, 2020

(54) VERTICAL DRILLING AND FRACTURING METHODOLOGY

(71) Applicant: SCHLUMBERGER TECHNOLOGY CORPORATION, Sugar Land, TX (US)

(72) Inventors: Dmitriy Potapenko, Sugar Land, TX (US); James Ernest Brown, Sugar Land, TX (US); Mathieu Vandermolen, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/553,701

(22) PCT Filed: Feb. 23, 2016

(86) PCT No.: PCT/US2016/019148
§ 371 (c)(1),
(2) Date: Aug. 25, 2017

(87) PCT Pub. No.: WO2016/138005
PCT Pub. Date: Sep. 1, 2016

(65) Prior Publication Data

US 2018/0023375 A1 Jan. 25, 2018

Related U.S. Application Data

(60) Provisional application No. 62/121,833, filed on Feb. 27, 2015.

(51) Int. Cl.
*E21B 43/30* (2006.01)
*E21B 43/26* (2006.01)
(Continued)

(52) U.S. Cl.
CPC ..... *E21B 43/305* (2013.01); *E21B 7/04* (2013.01); *E21B 43/114* (2013.01); *E21B 43/17* (2013.01);
(Continued)

(58) Field of Classification Search
CPC ..... E21B 43/305; E21B 43/14; E21B 43/26; E21B 43/11; E21B 43/267; E21B 7/04; E21B 33/14
(Continued)

(56) References Cited

U.S. PATENT DOCUMENTS 2,198,119 A 4/1940 Krengel
2,672,409 A 3/1954 Perkins
(Continued)

FOREIGN PATENT DOCUMENTS

CN 102504292 A 6/2012
CN 105349166 A 2/2016
(Continued)

OTHER PUBLICATIONS

International Search Report and Written Opinion issued in International Patent Appl. No. PCT/US2016/019148 dated May 19, 2016; 14 pages.
(Continued)

*Primary Examiner* — Matthew R Buck
*Assistant Examiner* — Patrick F Lambe
(74) *Attorney, Agent, or Firm* — Rodney Warfford

(57) ABSTRACT

A method for drilling and fracturing a subterranean formation includes drilling a substantially horizontal pilot well from a previously drilled vertical pilot well. A plurality of substantially vertical sidetracks is drilled from the horizontal pilot well. Fracturing fluid is pumped into the plurality of vertical sidetracks to hydraulically fracture the subterranean formation.

20 Claims, 10 Drawing Sheets

(51) Int. Cl.

| | |
|---|---|
| ***E21B 43/17*** | (2006.01) |
| ***E21B 7/04*** | (2006.01) |
| ***E21B 43/114*** | (2006.01) |
| *E21B 33/14* | (2006.01) |
| *E21B 43/11* | (2006.01) |
| *E21B 43/267* | (2006.01) |

(52) U.S. Cl.
CPC ..... *E21B 43/26* (2013.01); *E21B 33/14* (2013.01); *E21B 43/11* (2013.01); *E21B 43/267* (2013.01)

(58) Field of Classification Search
USPC ..... 166/308.1
See application file for complete search history.

(56) References Cited

U.S. PATENT DOCUMENTS

| | | | | |
|---|---|---|---|---|
| 2,731,414 | A | 1/1956 | Binder, Jr. | |
| 2,808,109 | A | 10/1957 | Kirk | |
| 3,282,337 | A | 11/1966 | Pye | |
| 3,336,221 | A | 8/1967 | Ralston | |
| 3,553,099 | A | 1/1971 | Savage | |
| 3,704,750 | A | 12/1972 | Miles | |
| 4,032,460 | A | 6/1977 | Zilch et al. | |
| 4,036,732 | A | 7/1977 | Irani et al. | |
| 4,046,668 | A | 9/1977 | Farcasiu et al. | |
| 4,046,669 | A | 9/1977 | Blaine et al. | |
| 4,108,760 | A | 8/1978 | Williams et al. | |
| 4,139,450 | A | 2/1979 | Hanson et al. | |
| 4,347,118 | A | 8/1982 | Funk et al. | |
| 4,613,631 | A | 9/1986 | Espenscheid et al. | |
| 4,666,683 | A | 5/1987 | Brown et al. | |
| 4,977,961 | A | 12/1990 | Avasthi | |
| 5,261,489 | A | 11/1993 | Jennings, Jr. et al. | |
| 5,335,726 | A | 8/1994 | Rodrigues | |
| 5,358,051 | A | 10/1994 | Rodrigues | |
| 5,868,210 | A | 2/1999 | Johnson et al. | |
| 5,893,416 | A | 4/1999 | Read | |
| 6,581,690 | B2 | 6/2003 | Van Drentham-Susman et al. | |
| 7,347,260 | B2 | 3/2008 | Ferguson et al. | |
| 7,422,059 | B2 | 9/2008 | Jelsma | |
| 7,431,083 | B2 | 10/2008 | Olsen | |
| 7,441,595 | B2 | 10/2008 | Jelsma | |
| 7,686,101 | B2 | 3/2010 | Belew et al. | |
| 7,971,658 | B2 | 7/2011 | Buckman, Sr. | |
| 7,971,659 | B2 | 7/2011 | Gatlin et al. | |
| 8,201,643 | B2 | 6/2012 | Soby et al. | |
| 8,220,547 | B2 | 7/2012 | Craig et al. | |
| 8,372,786 | B2 | 2/2013 | Berkland et al. | |
| 8,408,333 | B2 | 4/2013 | Pai et al. | |
| 8,420,576 | B2 | 4/2013 | Eoff et al. | |
| 8,424,620 | B2 | 4/2013 | Perry, Jr. et al. | |
| 8,590,618 | B2 | 11/2013 | Jelsma | |
| 8,770,316 | B2 | 7/2014 | Jelsma | |
| 9,121,272 | B2 | 9/2015 | Potapenko et al. | |
| 9,567,809 | B2 | 2/2017 | Savage | |
| 9,803,134 | B2 | 10/2017 | De Wolf et al. | |
| 10,005,955 | B2 | 6/2018 | Beuterbaugh et al. | |
| 2002/0005286 | A1 | 1/2002 | Mazorow et al. | |
| 2003/0062167 | A1 | 4/2003 | Surjaatmadja et al. | |
| 2005/0230107 | A1* | 10/2005 | McDaniel ..... | E21B 43/25 166/249 |
| 2006/0048946 | A1 | 3/2006 | Al-Muraikhi | |
| 2007/0261852 | A1 | 11/2007 | Surjaatmadja et al. | |
| 2007/0261887 | A1 | 11/2007 | Pai et al. | |
| 2008/0135292 | A1 | 6/2008 | Sihler et al. | |
| 2008/0139418 | A1 | 6/2008 | Cioletti et al. | |
| 2009/0101414 | A1 | 4/2009 | Brunet et al. | |
| 2009/0288884 | A1 | 11/2009 | Jelsma | |
| 2010/0126722 | A1 | 5/2010 | Cornelissen et al. | |
| 2010/0187012 | A1 | 7/2010 | Belew et al. | |
| 2010/0243266 | A1 | 9/2010 | Soby et al. | |
| 2011/0017468 | A1 | 1/2011 | Birch et al. | |
| 2011/0061869 | A1 | 3/2011 | Abass et al. | |
| 2011/0147088 | A1 | 6/2011 | Brunet et al. | |
| 2012/0067646 | A1 | 3/2012 | Savage | |
| 2012/0160567 | A1 | 6/2012 | Belew et al. | |
| 2012/0325555 | A1 | 12/2012 | Jette et al. | |
| 2013/0000908 | A1 | 1/2013 | Walters et al. | |
| 2013/0019390 | A1 | 1/2013 | Onodera et al. | |
| 2013/0062125 | A1 | 3/2013 | Savage | |
| 2013/0220606 | A1 | 8/2013 | Yhuel et al. | |
| 2013/0341029 | A1* | 12/2013 | Roberts ..... | E21B 43/263 166/308.1 |
| 2014/0096950 | A1 | 4/2014 | Pyecroft et al. | |
| 2014/0102708 | A1 | 4/2014 | Purkis et al. | |
| 2014/0144623 | A1 | 5/2014 | Pyecroft et al. | |
| 2015/0337613 | A1 | 11/2015 | Belew et al. | |
| 2016/0053597 | A1 | 2/2016 | Brown et al. | |
| 2016/0115772 | A1 | 4/2016 | Graham et al. | |
| 2016/0131787 | A1 | 5/2016 | Quirein et al. | |
| 2016/0153239 | A1 | 6/2016 | Randall | |
| 2016/0215581 | A1 | 7/2016 | Ingraham et al. | |
| 2016/0281480 | A1 | 9/2016 | Pyecroft et al. | |
| 2016/0312587 | A1 | 10/2016 | Montaron et al. | |
| 2017/0030180 | A1 | 2/2017 | Maurer | |
| 2017/0074722 | A1 | 3/2017 | Zhang et al. | |
| 2017/0078989 | A1 | 3/2017 | Kravets et al. | |
| 2018/0163122 | A1 | 6/2018 | Panga et al. | |
| 2019/0168885 | A1 | 6/2019 | Xiao et al. | |
| 2019/0241454 | A1 | 8/2019 | Faulkinbury | |
| 2019/0241455 | A1 | 8/2019 | Sweney et al. | |
| 2019/0241456 | A1 | 8/2019 | Shimizu et al. | |
| 2019/0241457 | A1 | 8/2019 | Nonaka et al. | |
| 2019/0241458 | A1 | 8/2019 | Sato | |

FOREIGN PATENT DOCUMENTS

| | | | | |
|---|---|---|---|---|
| GB | 2406863 | A | 4/2005 | |
| WO | 9113177 | A1 | 9/1991 | |
| WO | 0046484 | A1 | 8/2000 | |
| WO | WO-0046484 | A1 * | 8/2000 | ..... E21B 41/0035 |
| WO | 03050377 | A2 | 6/2003 | |
| WO | 2004046494 | A2 | 6/2004 | |
| WO | 2005090747 | A1 | 9/2005 | |
| WO | 2009096805 | A1 | 8/2009 | |
| WO | 2015089458 | A1 | 6/2015 | |
| WO | 2018049311 | A1 | 3/2018 | |
| WO | 2018049367 | A1 | 3/2018 | |
| WO | 2018049368 | A1 | 3/2018 | |
| WO | 2018129136 | A1 | 7/2018 | |
| WO | 2019014160 | A1 | 1/2019 | |
| WO | 2019014161 | A1 | 1/2019 | |

OTHER PUBLICATIONS

Alekseenko, O. P., Potapenko, D.I., Cherny, S.G., Esipov, D.V., Kuranakov, D.S., Lapin, V.N. "3-D Modeling of fracture initiation from perforated non-cemented wellbore", SPE J., vol. 18, No. 3, 589-600, 2013.

Alekseenko O.P. , Potapenko D.I. , Kuranakov D.S. , Lapin V.N. , Cherny S.G. , and Esipov D.V. "3D Modeling of Fracture Initiation from Cemented Perforated Wellbore", presented at 19th European Conference on Fracture, Kazan, Russia, Aug. 26-31, 2012.

Potyondy, "Simulating stress corrosion with a bonded-particlle model for rock", International Journal of Rock Mechanics and Mining Sciences, vol. 44, Issue 5, Jul. 2007, pp. 677-691.

Atkinson et al., "Acoustic Emission During Stress Corrosion Cracking in Rocks", Earthquake Predition: An International Review, vol. 4, pp. 605-616, 1981.

Wikipedia.org, "Wood's metal", edited May 4, 2019, Accessed Jul. 3, 2019; https://en.wikipedia.org/wiki/Wood%27s_metal.

Pinto, I.S.S. et al., "Biodegradable chelating agents for industrial, domestic, and agricultural applications—a review", Environmental Science and Pollution Research, 2014, 21, pp. 11893-11906.

* cited by examiner

VERTICAL DRILLING AND FRACTURING METHODOLOGY

CROSS REFERENCE TO RELATED APPLICATIONS

The present document is based on and claims priority to U.S. Provisional Application Ser. No. 62/121,833 filed Feb. 27, 2015, which is incorporated herein by reference in its entirety.

FIELD OF THE INVENTION

Disclosed embodiments relate generally to methods and apparatuses for increasing the productivity of a well via hydraulically fracturing a subterranean formation and more particularly to methods for drilling and fracturing multilateral wellbores having a plurality of vertical fractured sections.

BACKGROUND INFORMATION

Wellbores are commonly drilled through subterranean formations to enable the extraction of hydrocarbons. Hydraulic fracturing is known to significantly increase the production rates of hydrocarbons in certain subterranean formation types (e.g., those having low fluid and/or gas permeability such as deep shale formations). In one common hydraulic fracturing operation, high pressure fluids are used to create localized fractures in the formation. The fluids may further include proppant (such as sand, bauxite, ceramic, nut shells, etc.) to hold the fractures partially open after the pump pressure is removed thereby enabling hydrocarbons to flow from the fractured formation into the wellbore. In carbonate reservoirs the fluid may include an acid, such as HCl. The acid is intended to etch the fracture faces to improve the flow capacity of the created hydraulic fracture.

The overall process for creating a hydraulically fractured wellbore commonly includes two or three primary operations; a drilling operation, an optional casing operation, and hydraulic fracturing operations. Hydraulic fracturing operations were initially performed in single stage vertical or near vertical wells. In order to improve productivity, hydraulic fracturing operations have trended towards almost exclusively horizontal or near horizontal wells.

While horizontal fracturing operations have improved productivity there is considerable room for yet further improvement. In particular there is room in the art for both productivity and efficiency improvements in hydraulic fracturing operations.

SUMMARY

A method for drilling and fracturing a subterranean formation is disclosed. The method includes drilling a substantially horizontal pilot well from a previously drilled vertical pilot well. A plurality of substantially vertical sidetracks is drilled from the horizontal pilot well. Fracturing fluid is pumped into the plurality of vertical sidetracks to hydraulically fracture the subterranean formation. The vertical sidetracks may be fractured sequentially or simultaneously.

The disclosed embodiments may provide various technical advantages. For example, the disclosed methods may enable significantly improved production and efficiency gains in hydraulic fracturing operations.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
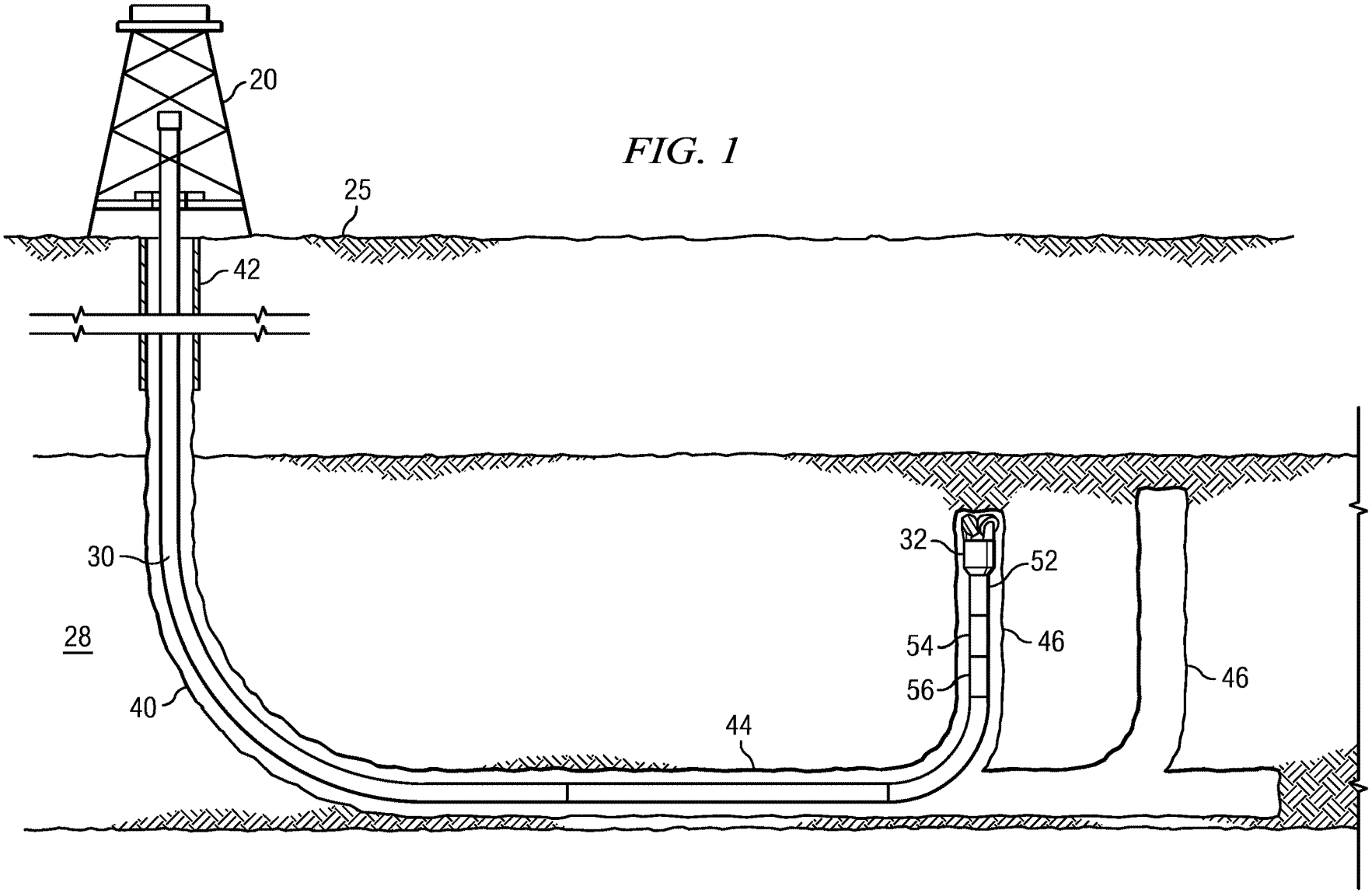
FIG. 1 depicts one example of a drilling rig on which disclosed drilling and hydraulic fracturing methods may be practiced.

FIG. 1 depicts a drilling rig 20 suitable for using various apparatus and method embodiments disclosed herein. The rig may be positioned over an oil or gas formation 28 disposed below the surface of the earth 25. The formation 28 may include substantially any suitable formation such as a horizontal Marcellus shale (the disclosed embodiments are of course not limited to any particular formations).

The rig 20 may include a derrick and a hoisting apparatus for raising and lowering a drill string 30, which, as shown, extends into wellbore 40 and includes a drill bit 32 and a number of downhole tools 52, 54, and 56. The downhole tools 52, 54, and 56 may include substantially any suitable downhole tools, for example, including a steering tool such as a rotary steerable tool, a logging while drilling (LWD) tool, a measurement while drilling tool (MWD) tool, a downhole drilling motor, a downhole telemetry system, and the like. The drill string may include a plurality of threaded pipes connected end to end or a length of coiled tubing. The drill string may further optionally include a fracturing while drilling assembly (not shown). The disclosed embodiments are not limited in any of these regards.

In the depicted embodiment, the wellbore system being drilled includes a cased vertical pilot well 42, an open hole horizontal pilot well 44, and first and second upwardly pointing substantially vertical sidetracks 46. The disclosed embodiments include various methods for drilling and fracturing wellbore systems including such vertical sidetracks (whether they are upwardly or downwardly pointing). It will be understood by those of ordinary skill in the art that the deployment illustrated on FIG. 1 is merely an example and is not intended to limit the disclosed embodiments in any way.

Figure 2:
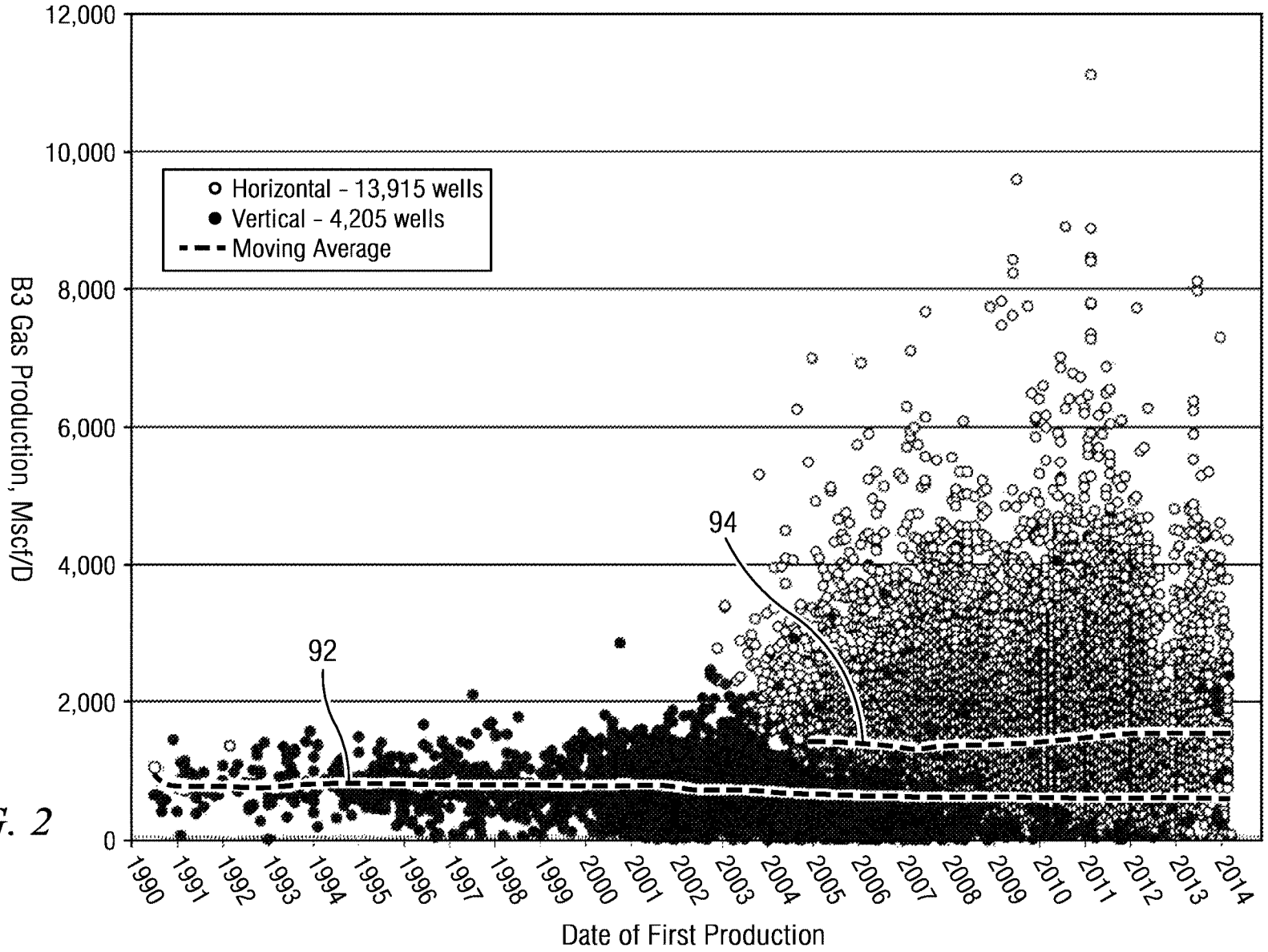
FIG. 2 depicts a plot of gas production versus the date of the first production of a number of wells in Barnett Shale.

FIG. 2 depicts a plot of gas production versus the date of the first production of a well in Barnett Shale. According to historical records, during the decade of the 1990s (about 1990-2000) and into the early 2000s (until about 2003) the vast majority of new wells in the Barnett Shale reservoir were essentially vertical and were stimulated in a single stage using about 100,000 to about 1,500,000 pounds of proppant and about 2,000 to about 15,000 barrels of fracturing fluid. Since that time new wells have been predominantly horizontal, with the vast majority being horizontal after about 2010. According to historical records, these horizontal wells were most commonly stimulated in about 5 to 12 stages using about 100,000 to about 450,000 pounds of proppant and about 2,000 to about 20,000 barrels of fracturing fluid per stage (i.e., for each of the 5 to 12 stages).

In FIG. 2 the production numbers are as measured over a three-month period. Vertical wells are plotted using darkened circles while horizontal wells are plotted using open circles. FIG. 2 further depicts a moving average of the gas production for the vertical wells 92 and a moving average of the gas production for the horizontal wells 94. As depicted, the moving average of the gas production for the vertical wells has been historically constant at about 650 thousand standard cubic feet per day. The moving average of the gas production for the horizontal wells has increased modestly from about 1300 to about 1600 thousand standard cubic feet per day.

Examination of the historical data depicted on FIG. 2 indicates that on average stimulating horizontal wells provides about a two and a half fold increase in daily gas production for each well. This represents a significant improvement in production and may be the primary driver for the recent transition from vertical to horizontal drilling and fracturing. However, this increased production comes at the expense of decreased efficiency. In particular, the majority of the horizontal wells were generally stimulated in 5 to 12 stages along the length of the horizontal wellbore, with each of the stages utilizing a comparable mass of proppant and about a comparable volume of fracturing fluid as was used in a single stage vertical fracturing operation.

Close examination of the historical data indicates that the production per fracturing stage for horizontal wells is about 0.2 to about 0.5 that of the vertical wells. Moreover, the same historical data further indicates that a greater quantity of proppant and fracturing fluid is required for per unit of gas production in the horizontal wells. In other words, with respect to the efficiency of production, there is a reduction in the quantity of gas produced per fracturing stage as well as per pound of proppant and barrel a fracturing fluid in a horizontal completion as compared to a vertical completion. While the data depicted on FIG. 2 are for wells drilled in the Barnett Shale, it will be understood that the production statistics for wells drilled in other basins are similar (e.g., for the Woodford, Eagle Ford, Baaken and Haynesville Shale's).

Figure 3A:
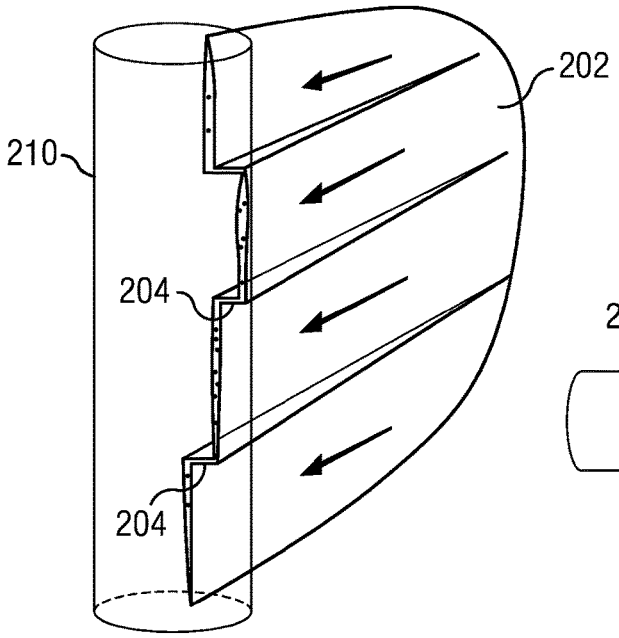
FIGS. 3A and 3B depict schematic illustrations of fractures propagated in vertical (FIG. 3A) and horizontal (FIG. 3B) wellbores.
Figure 3B:
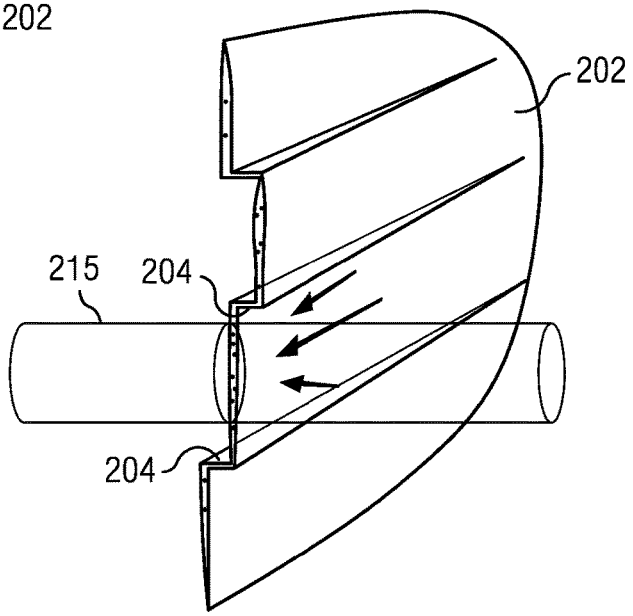

While this decreased stimulation efficiency in horizontal wells is not fully understood, it is proposed herein that one influential factor is related to the nature of fracture propagation and closure in layered formations. It is believed that the nature of fracture propagation and the ultimate shape and geometry of the fracture is somewhat independent of the orientation of the wellbore from which the fractures are induced. Fracture propagation is believed to depend primarily upon the properties of the formation (e.g., the maximum stress direction of the formation). FIGS. 3A and 3B depict hypothetical and schematic illustrations of fractures 202 propagated (induced) from vertical (3A) and horizontal (3B) wellbores 210 and 215. When the fracturing pressure is released, the fractures closes around proppant particles in the fracturing fluid (such as sand). The proppant is intended to prevent the fractures from fully closing so that formation fluids flow into the wellbore. Notwithstanding, upon closure (or partial closure) of the fractures about the proppant, the presence of pinch points 204 may restrict the flow of formation fluids between sedimentary layers such that the production is generally from intersected layers (layers that are intersected by the wellbore). Owing to the near horizontal orientation of many sedimentary layers, it is believed that fractures induced from a vertical or deviated wellbore enable wellbore fluids to be produced from a greater number of sedimentary layers in the formation (since the vertical wellbore intersects a greater number of layers). This may result in a greater production per fracture in a vertical well than in a horizontal well which in turn may explain the production efficiency losses in horizontal wells.

One aspect of the instant disclosure is the realization that production efficiency may be enhanced via drilling and fracturing a wellbore system including a plurality of vertical sections (e.g., having an inclination of less than 45 degrees or greater than 135 degrees as discussed in more detail below) drilled along the same horizon. For example, as described in more detail below, a wellbore system may include a horizontal pilot well extending laterally away from a vertical pilot. A plurality of vertical sidetracks may be drilled out (e.g., upwards or downwards) from the horizontal pilot well and then fractured. The wellbore system may further include a plurality of horizontal pilot wells extending from a single vertical pilot well with each of the horizontal pilot wells including a plurality of fractured vertical sidetracks.

Figure 4:
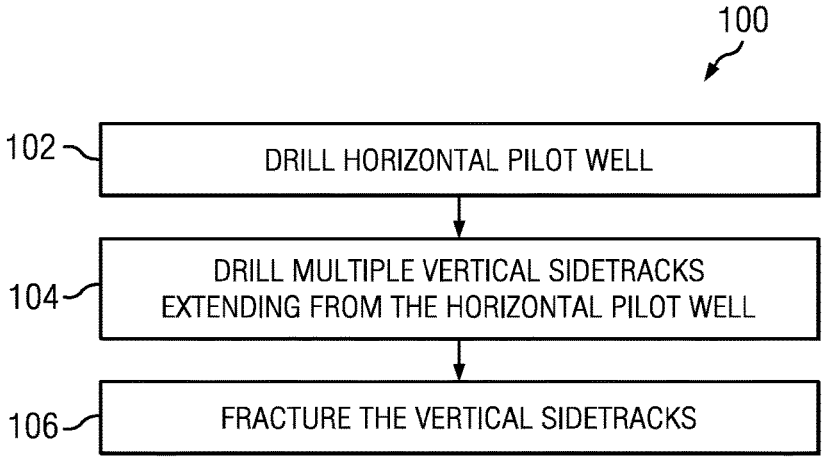
FIG. 4 depicts a flow chart of one disclosed method embodiment.

FIG. 4 depicts a flow chart of one disclosed method embodiment 100. At 102 a substantially horizontal pilot wellbore is drilled (e.g., from a previously drilled and cased substantially vertical pilot well). The wellbore is substantially horizontal in that it has a wellbore inclination of greater than about 45 degrees (e.g., greater than about 60 degrees or greater than about 75 degrees). At 104 a plurality of substantially vertical sidetracks are drilled from the horizontal pilot well. The sidetracks are substantially vertical in that they have a wellbore inclination of less than about 45 degrees (e.g., less than about 30 degrees or less than about 15 degrees). At 106 the vertical sidetracks are fractured. While the disclosed embodiments are not limited to any particular plurality of vertical sidetracks it will be understood that increasing the number of sidetracks tends to increase the overall production efficiency gains. Thus the wellbore system may advantageously include greater than five or more (or 10 or more, or 15 or more) vertical sidetracks extending from each horizontal pilot well.

It will be understood that the terms vertical and horizontal (or substantially vertical and substantially horizontal) are not intended to mean exactly vertical or exactly horizontal with respect to the surface of the Earth (or with respect to the Earth's gravitational field). In other words a vertical wellbore is not to be understood as necessarily having an inclination of exactly (or nearly) 0 or 180 degrees. Likewise, a horizontal wellbore is not to be understood as necessarily having an inclination of exactly 90 degrees. Rather these terms are intended to refer to wellbores having an inclination within a range of values about true vertical and true horizontal. For example, a vertical (or substantially vertical)

wellbore may broadly be understood to have a wellbore inclination of less than 45 degrees or greater than 135 degrees (depending on whether the wellbore is directed downwards or upwards). A vertical (or substantially vertical) wellbore may also be understood to have a wellbore inclination of less than 30 degrees or greater than 150 degrees, or less than 15 degrees or greater than 165 degrees, or less than 10 degrees or greater than 170 degrees. Likewise, a horizontal (or substantially horizontal) wellbore may broadly be understood to have a wellbore inclination of less than 135 degrees and greater than 45 degrees. A horizontal (or substantially horizontal) wellbore may also be understood to have a wellbore inclination of less than 120 degrees and greater than 60 degrees, or less than 105 degrees and greater than 75 degrees, or less than 100 degrees and greater than 80 degrees.

It will be further understood that fractures often propagate along a direction of maximum formation stress (or in the plane of maximum formation stress). Thus the horizontal pilot wellbore may be drilled along a direction of maximum formation stress and the vertical sidetracks may be drilled in a direction substantially orthogonal to the direction of maximum formation stress (or substantially orthogonal to the plane of maximum formation stress). In certain embodiments the direction of maximum formation stress may be measured while drilling (e.g., while drilling the vertical pilot well), for example, using acoustic or nuclear logging while drilling measurements. These measurements may then be used to select the directions of the horizontal pilot well and the vertical sidetracks.

With reference again to FIG. 4, it will be understood that the vertical sidetracks may be fractured sequentially or simultaneously. For example, a first vertical sidetrack may be drilled in 104 and then fractured in 106 using a fracturing while drilling tool. A second vertical sidetrack may then be drilled in 104 and fractured in 106 using the fracturing while drilling tool. This sequential process may continue until the wellbore system is completed having substantially any number of vertical sidetracks (e.g., five or more, 10 or more, or 15 or more). Substantially any suitable fracturing while drilling tool or fracturing while tripping tool may be utilized, for example, including the fracturing while drilling and fracturing while tripping tool embodiments disclosed in commonly assigned U.S. patent application Ser. No. 14/466,705, which is incorporated by reference in its entirety herein. In an alternative embodiment, the vertical sidetracks may first be drilled in 104. The vertical sidetracks may then be fractured using a single stage or multi-stage fracturing operation in which a plurality of vertical sidetracks is fractured in each stage.

With continued reference to FIG. 4, it will be further understood that the vertical sidetracks may be drilled from "toe to heal" or from "heal to toe" along the horizontal pilot well. For example, as described in more detail below with respect to FIGS. 5A-5F, the horizontal pilot well may be drilled to its final length before drilling the vertical sidetracks. After drilling the horizontal pilot to its final length, the vertical sidetracks may be drilled toe to heal along the horizontal pilot (i.e., beginning at the end of the horizontal pilot having the greatest measured depth and proceeding back towards the vertical pilot and therefore back towards the surface). The vertical side tracks may alternatively be drilled heal to toe, for example, by drilling a horizontal section and steering the wellbore up or down to drill the vertical side track. The horizontal section may then be extended and the wellbore steered to drill a subsequent vertical sidetrack. This process may continue such that substantially any suitable number of vertical sidetracks is drilled along an incrementally extended horizontal pilot. As described, the vertical side tracks may be fractured sequentially or simultaneously. One such embodiment is described in more detail below with respect to FIGS. 7A-7D.

One embodiment of method 100 (FIG. 4) is now described in further detail with respect to FIGS. 5A-5F. A vertical pilot well is drilled and cased as shown. The horizontal pilot well 265 is drilled from the vertical pilot well 255 in FIG. 5A (e.g., at 102 in FIG. 4). While the vertical pilot well is depicted as being cased and cemented, it will be understood that the disclosed embodiments are not so limited (the vertical pilot well may remain an open hole well). A first vertical sidetrack 272 is drilled as depicted on FIG. 5B (e.g., at 104 in FIG. 4). The first vertical sidetrack 272 may be isolated from the horizontal pilot well 265, for example, via expanding (inflating) packers 252 deployed on the drill string 250. High pressure fracturing fluid (or drilling fluid) may be pumped down through the drill string into the isolated annular region via fracturing ports 254 which may also be deployed on the drill string. This "fracturing while drilling" operation may thus be employed to fracture the formation surrounding the first vertical sidetrack as depicted at 282 on FIG. 5C.

Figure 5A:
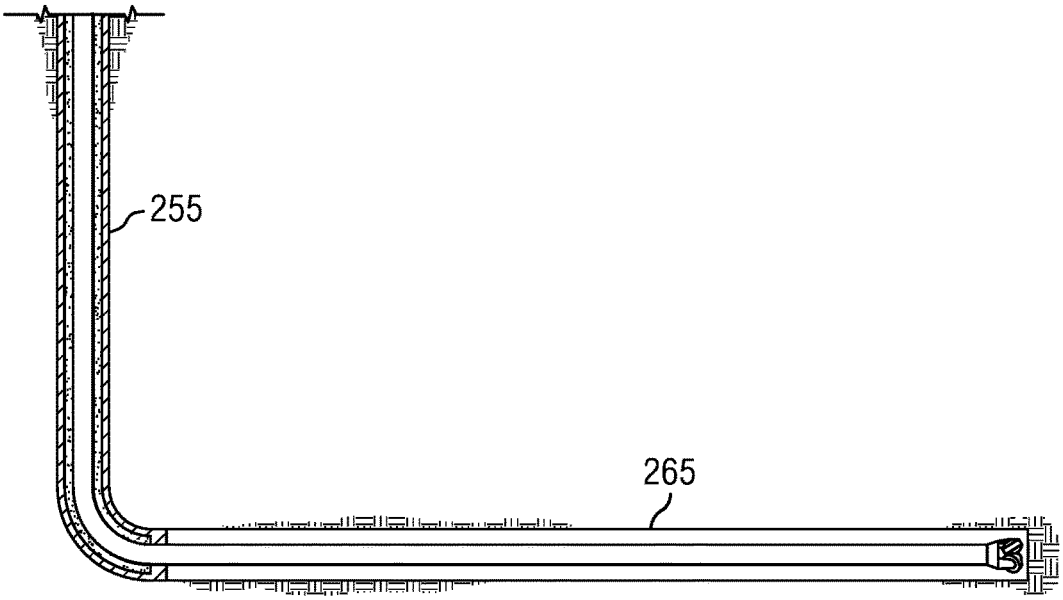
FIGS. 5A-5F (collectively FIG. 5) further depict one example of the method embodiment illustrated on FIG. 4.
Figure 5B:
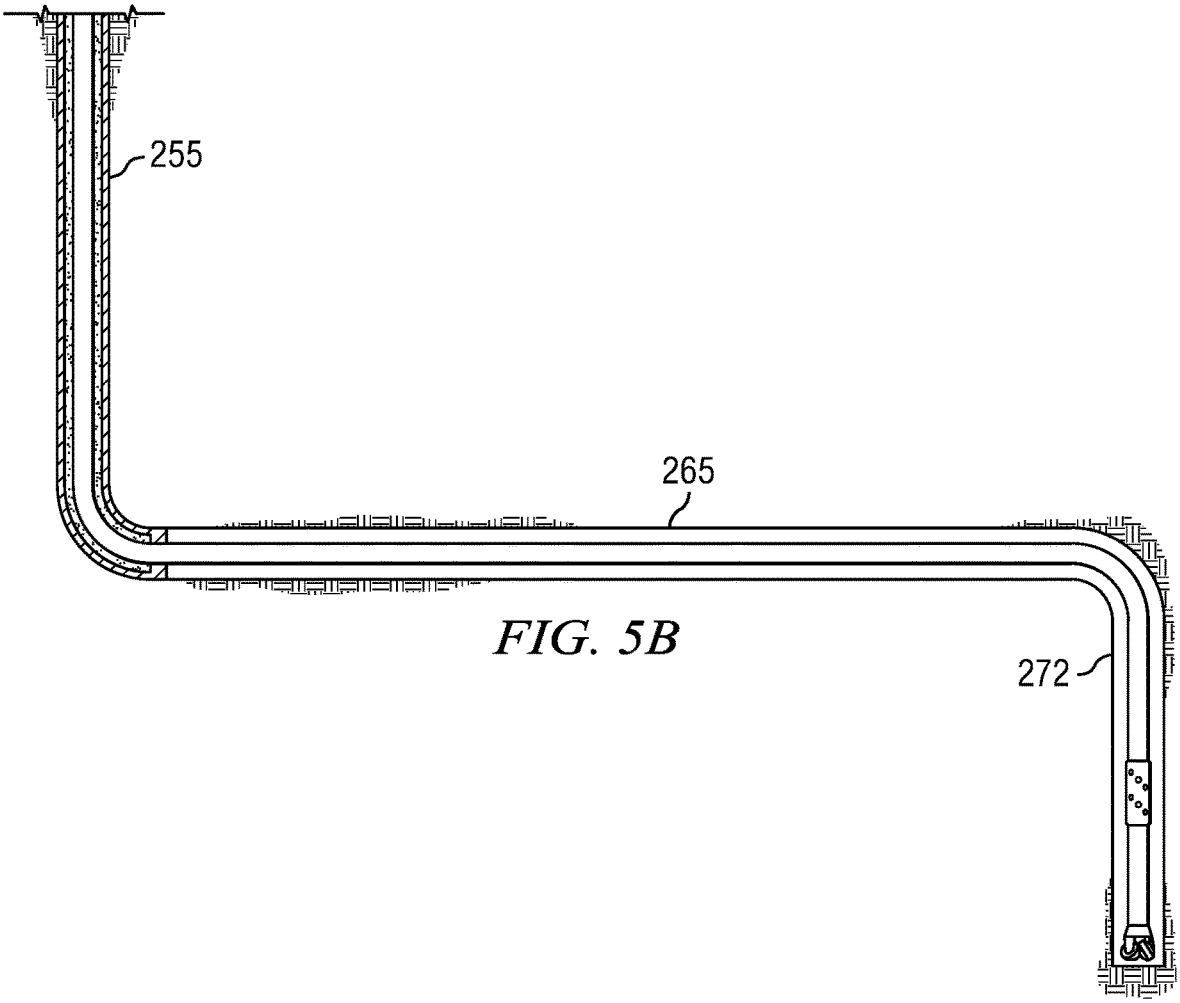
Figure 5C:
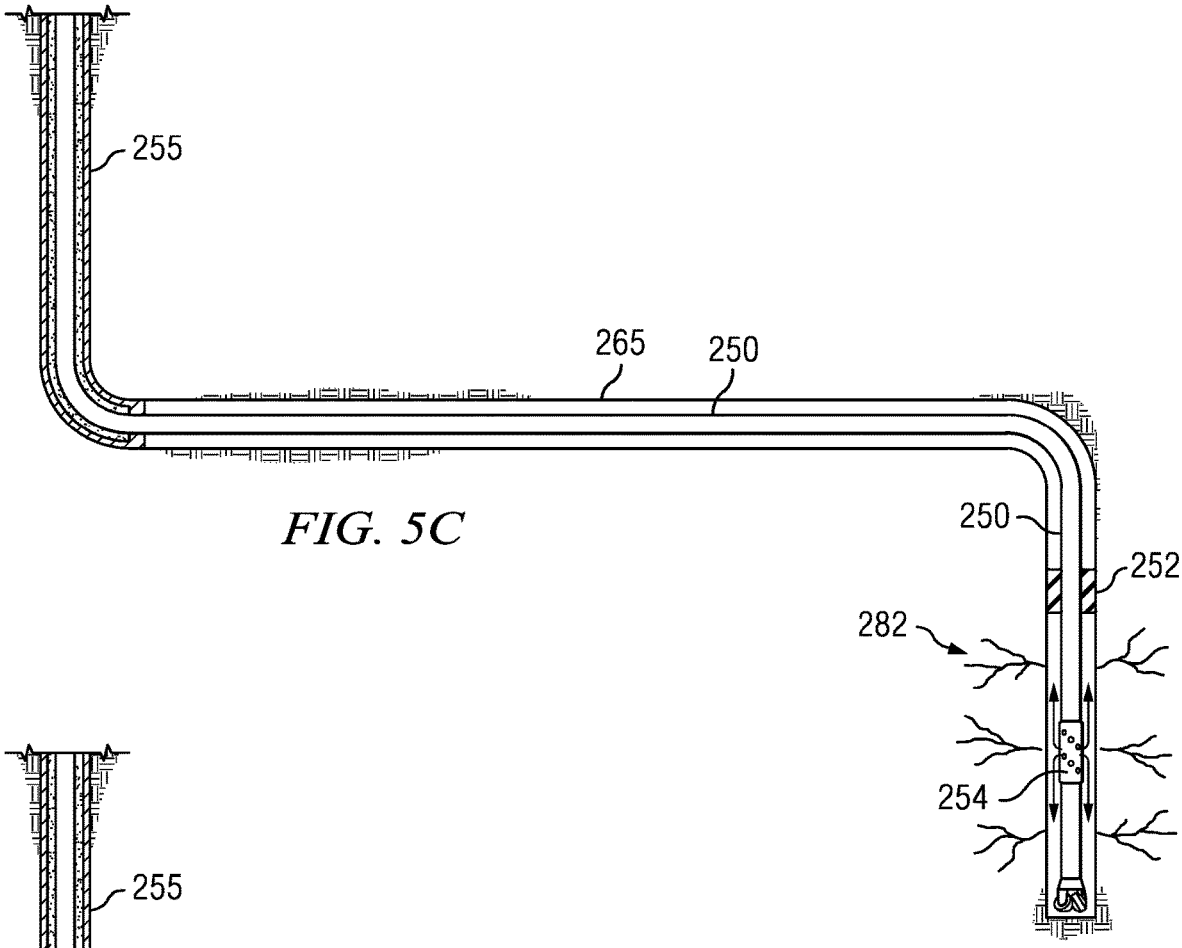
Figure 5D:
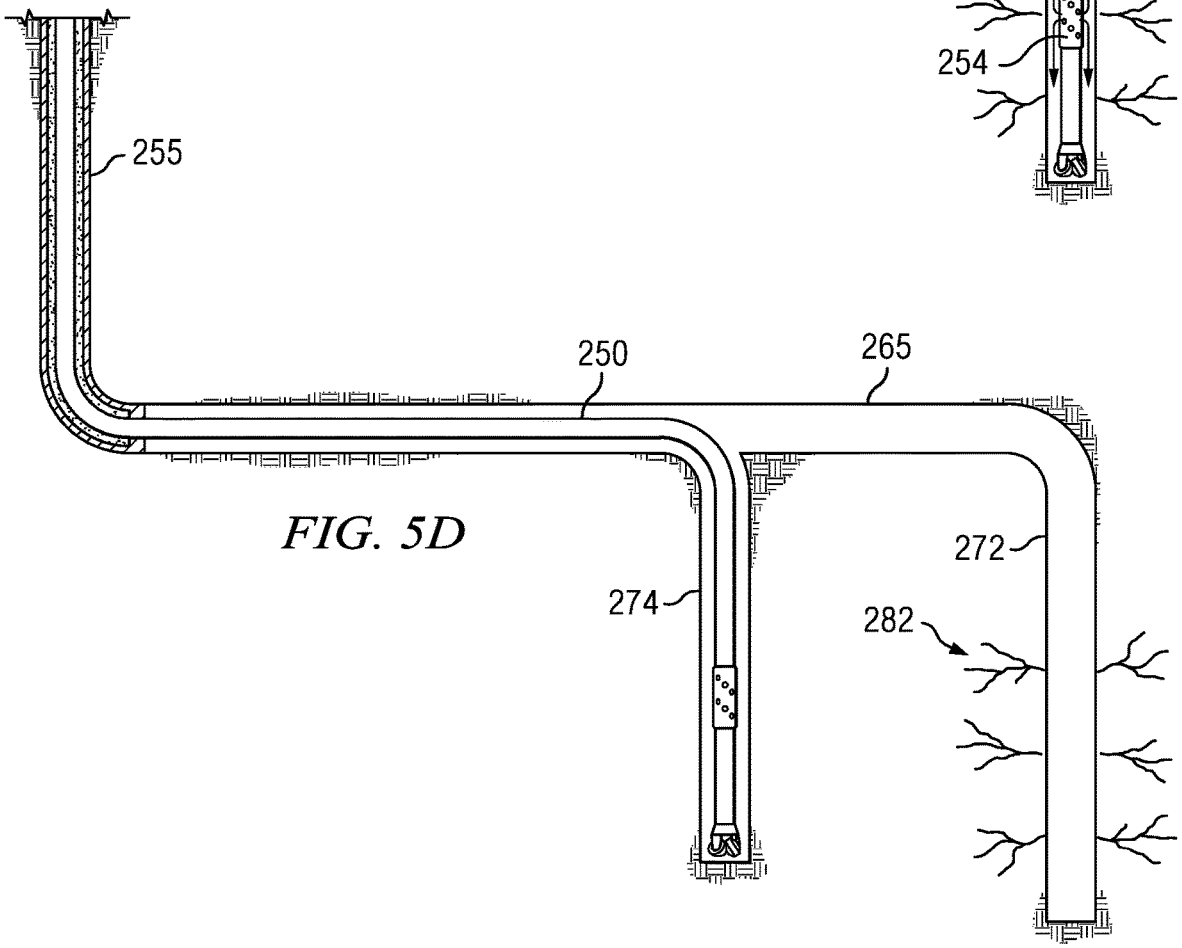
Figure 5E:
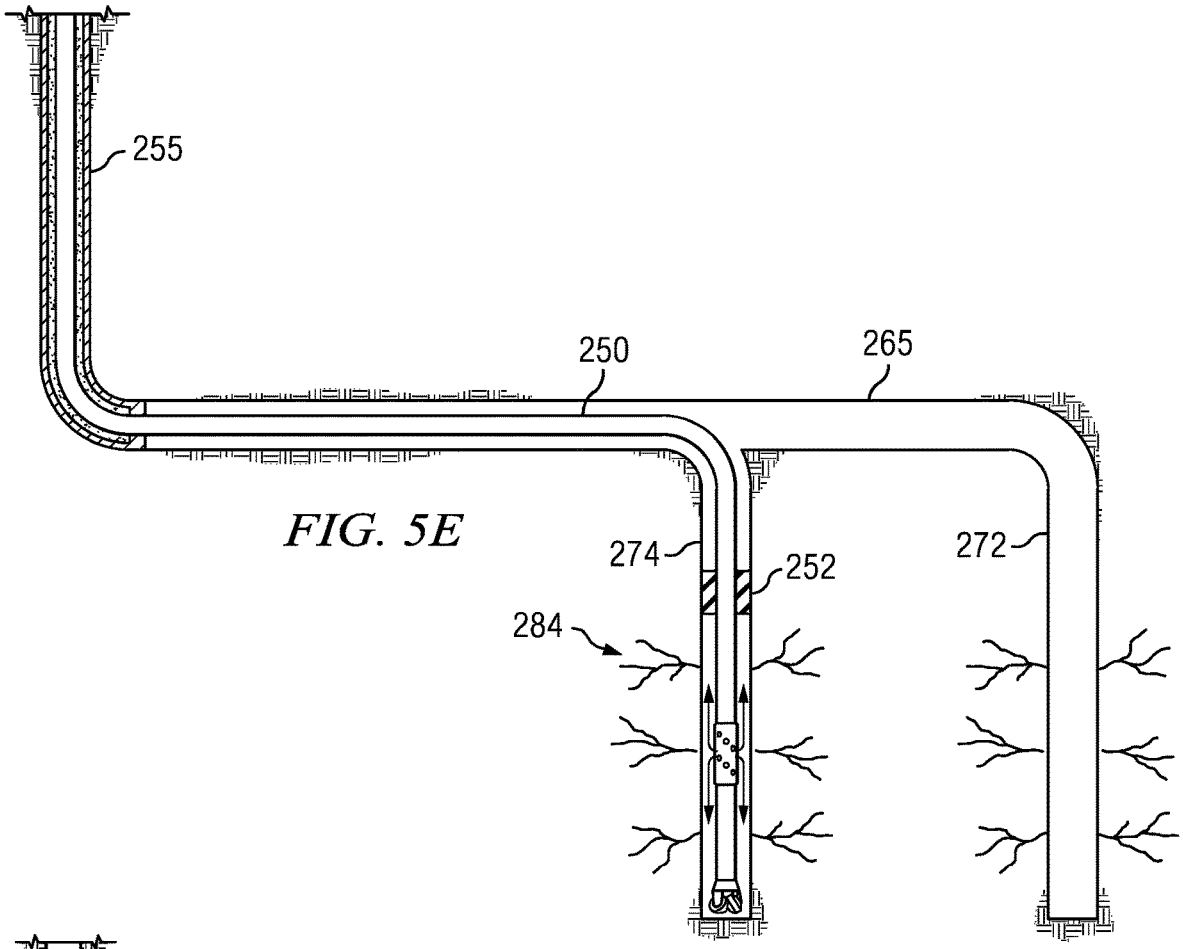
Figure 5F:
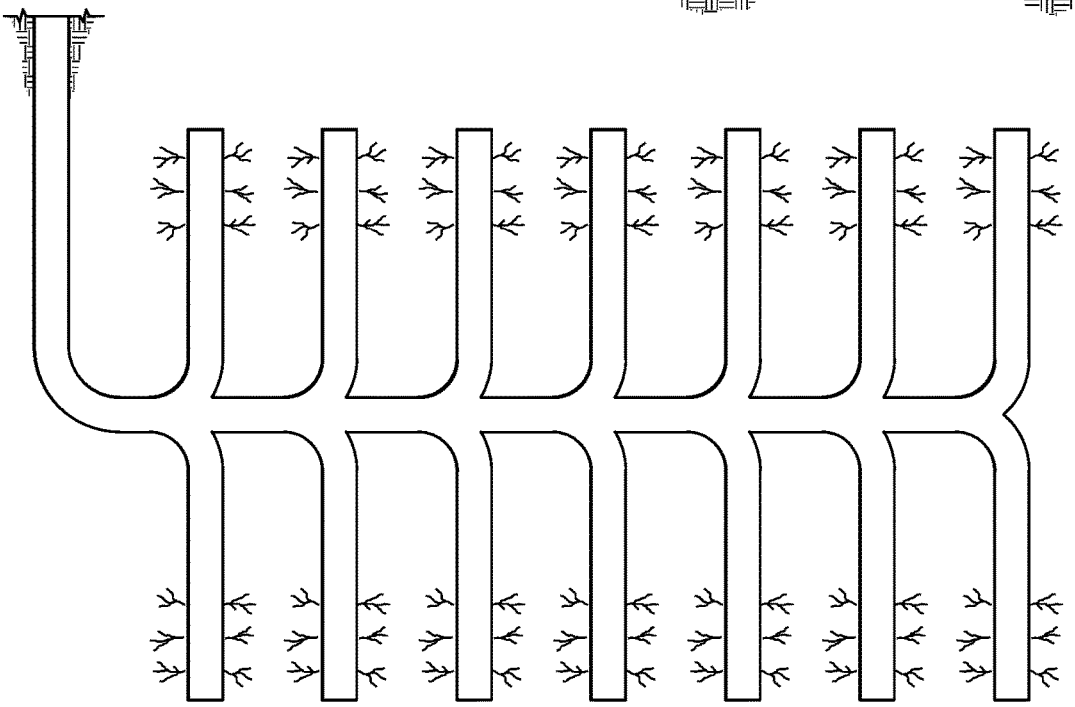

After the first vertical sidetrack 272 has been fractured, a second vertical sidetrack 274 may be drilled from the horizontal pilot 265 as depicted on FIG. 5D. The second vertical sidetrack 274 may then be fractured in the same manner as described above for the first vertical sidetrack 272 as depicted at 284 on FIG. 5E. As depicted on FIG. 5F, substantially any plural number of vertical sidetracks may be drilled from the horizontal pilot 265 and fractured. The vertical sidetracks may extend upward and/or downward from the horizontal pilot 265 as depicted. The disclosed embodiments are not limited in this regard. For example, the horizontal pilot may be drilled along (or near) the lower boundary of a formation of interest (e.g., as depicted on FIG. 1) with vertical sidetracks extending upwards into the formation. Alternatively, the horizontal pilot may be drilled along (or near) the upper boundary of a formation of interest with vertical sidetracks extending downwards into the formation. In still another embodiment, the horizontal pilot may be drilled near the center of the formation of interest with vertical sidetracks extending upwards and downwards (e.g., as depicted on FIG. 5F). For the purposes of this disclosure an upwardly pointing vertical sidetrack may be defined as having a wellbore inclination of greater than about 135 degrees (e.g., greater than about 150 degrees or greater than about 165 degrees) while a downwardly pointing vertical sidetrack may be defined as having a wellbore inclination of less than about 45 degrees (e.g., less than about 30 degrees or less than about 15 degrees). Alternatively, a single quadrant wellbore inclination value may be used (which ranges from 0 to 90 degrees with 0 degrees representing vertical and 90 degrees representing horizontal) in which case the vertical sidetracks (whether upwardly or downwardly pointing) have a wellbore inclination less than about 45° (e.g., less than about 30 degrees or less than about 15 degrees).

Figure 6A:
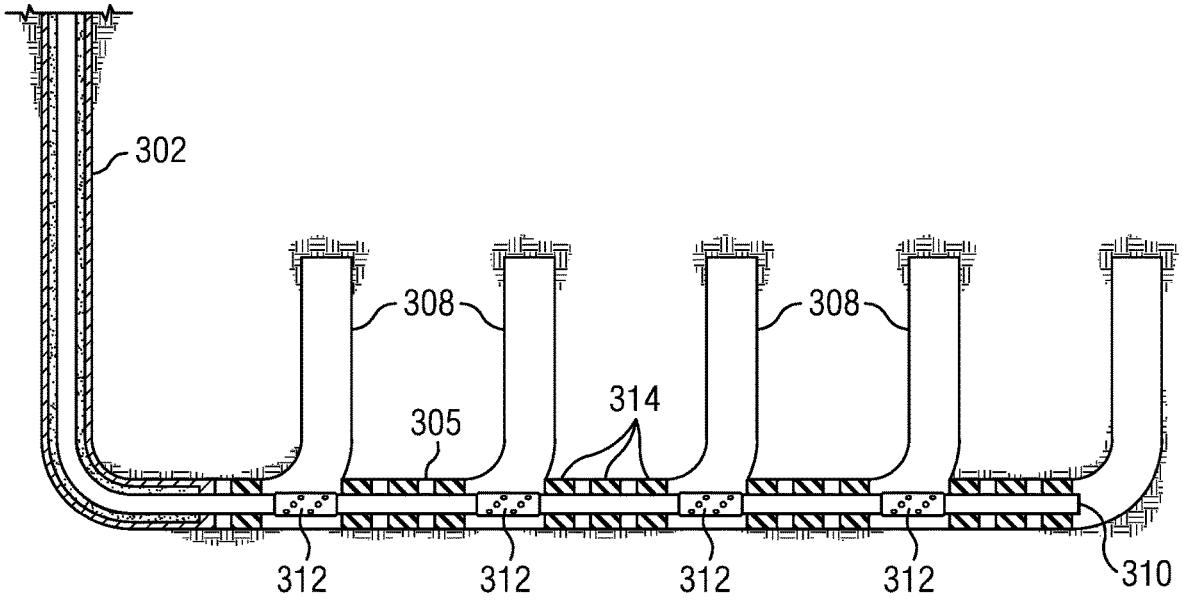
FIGS. 6A-6C (collectively FIG. 6) depict alternative embodiments of the method illustrated on FIG. 4.
Figure 6B:
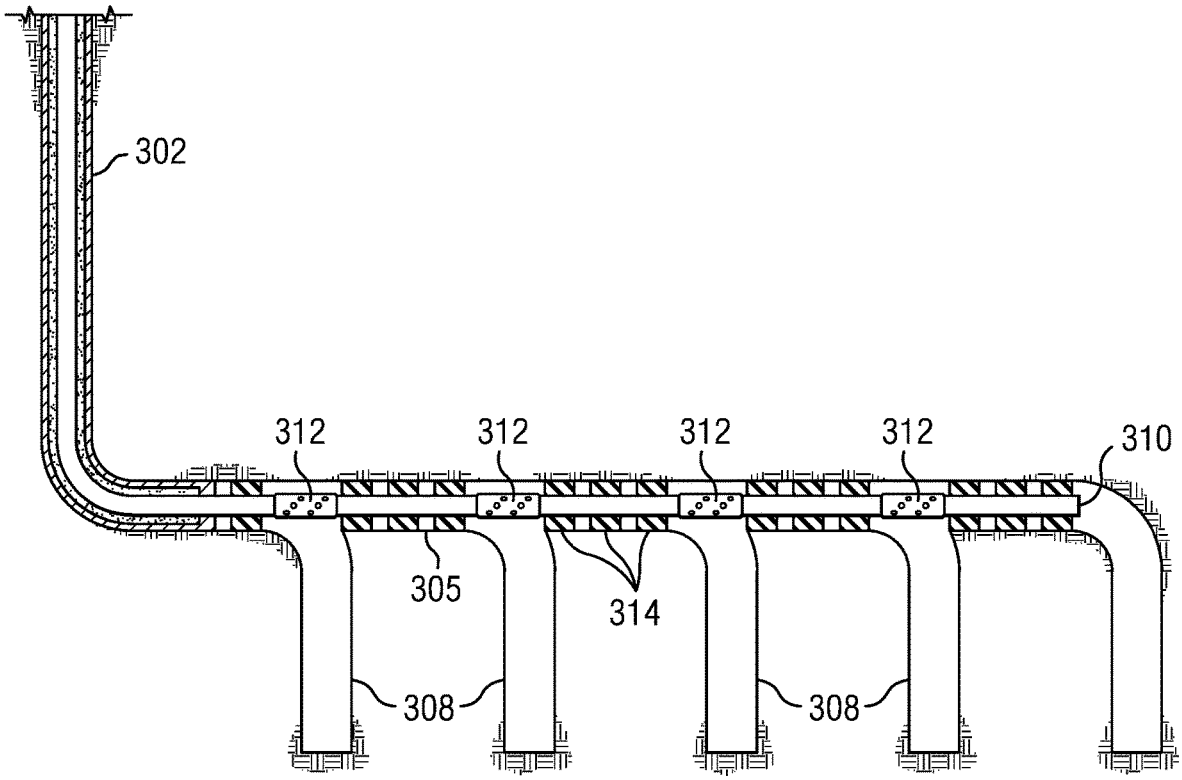
Figure 6C:
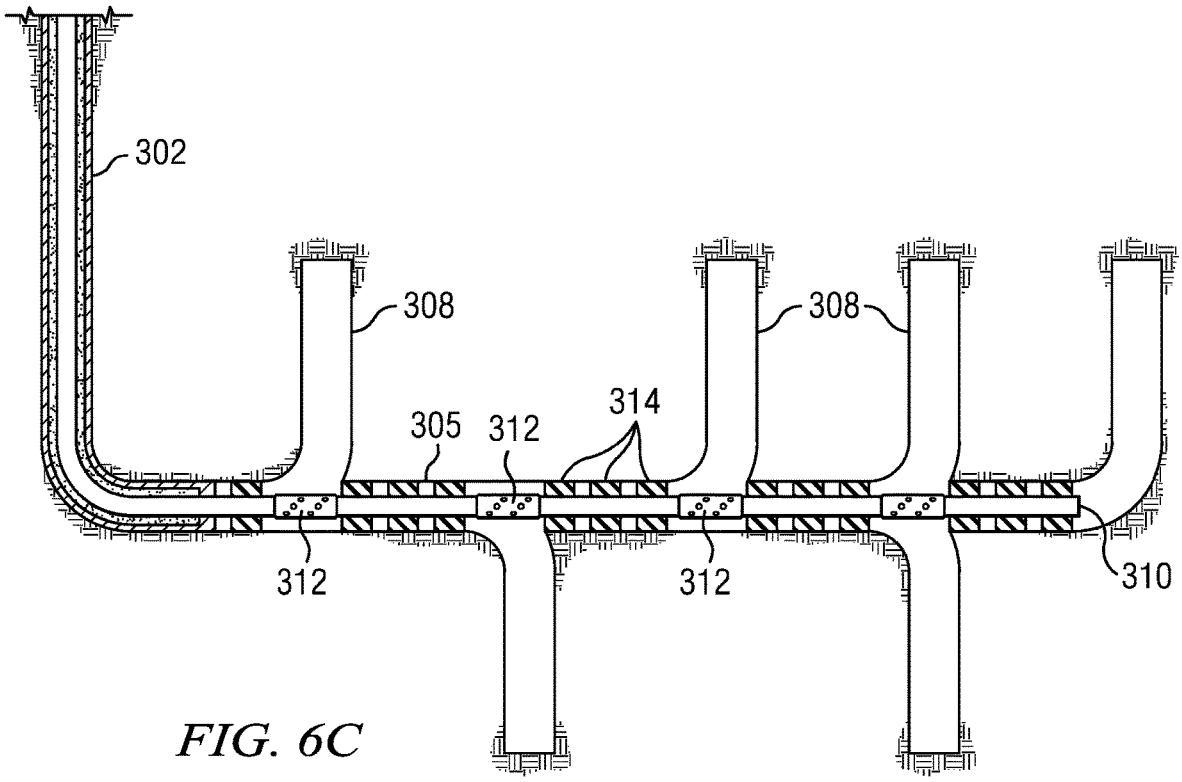

An alternative embodiment of method 100 (FIG. 4) is now described in further detail with respect to FIGS. 6A-6C. In this embodiment, the vertical sidetracks may be fractured (e.g., in 106 of FIG. 4) without entry of a fracturing tool therein. FIG. 6A depicts a wellbore system having an open hole horizontal pilot well 305 extending from a cemented and cased vertical pilot well 302. A plurality of open hole vertical sidetracks 308 extend upwards from the horizontal pilot 305 as depicted. A fracturing tool 310 is shown deployed in the horizontal pilot 305. In this particular non-limiting embodiment, the fracturing tool may employ a plurality of fracturing sleeves 312 deployed adjacent to individual vertical sidetracks 308 and open hole packers 314 deployed between adjacent ones of the vertical sidetracks 308. The packers may be expanded (as depicted) to isolate the individual vertical sidetracks from one another. The vertical sidetracks 308 may be stimulated (and thereby fractured) by opening and closing ports in one or more of the fracturing sleeves 312 and pumping high pressure fracturing fluid from the surface into the adjacent vertical sidetracks. In this way a multi-stage fracturing operation may be employed in which the vertical sidetracks 308 are fractured one by one, in pairs, in triplets, or in any other suitable combination. In embodiments in which the wellbore system employs relatively few vertical sidetracks a single stage fracturing operation may also be utilized. FIGS. 6B and 6C depict alternative embodiments in which both upwardly and downwardly pointing vertical sidetracks 308 are employed.

It will be understood that the decision regarding whether to fracture adjacent vertical sidetracks sequentially or simultaneously (and how many sidetracks may be fractured simultaneously) may be based on numerous operational factors. For example, the decision may depend upon the existing rig or derrick height. Larger rigs may generally accommodate a hydraulic fracturing tool including a large number of fracture ports and may therefore be suitable for simultaneous hydraulic fracturing (while a smaller rig may not). The decision may also depend upon the pump pressure required to propagate the fractures and the desired depth of such fractures. For certain formations or formation types (e.g., those requiring higher pressures) it may be advantageous to fracture the zones sequentially. Simultaneous hydraulic fracturing of multiple zones may generally lead to a faster fracturing operation and thus may sometimes be preferred (assuming adequate rigging and pumping capabilities are in place and assuming suitable formation fracturing can be achieved).

Figure 7A:
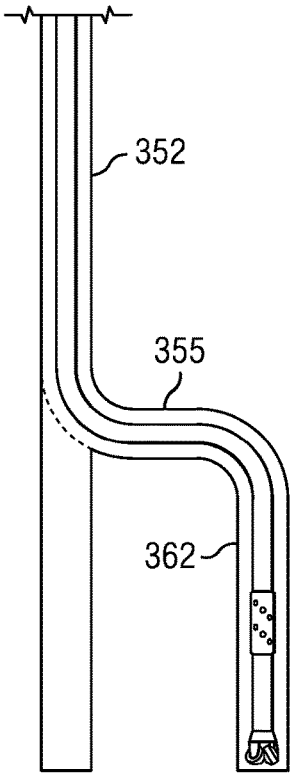
FIGS. 7A-7D (collectively FIG. 7) depict further alternative embodiments of the method illustrated on FIG. 4.
Figure 7B:
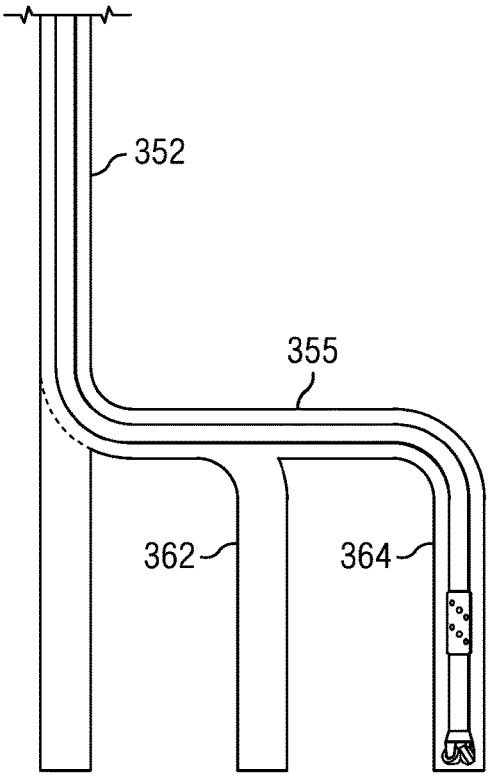
Figure 7C:
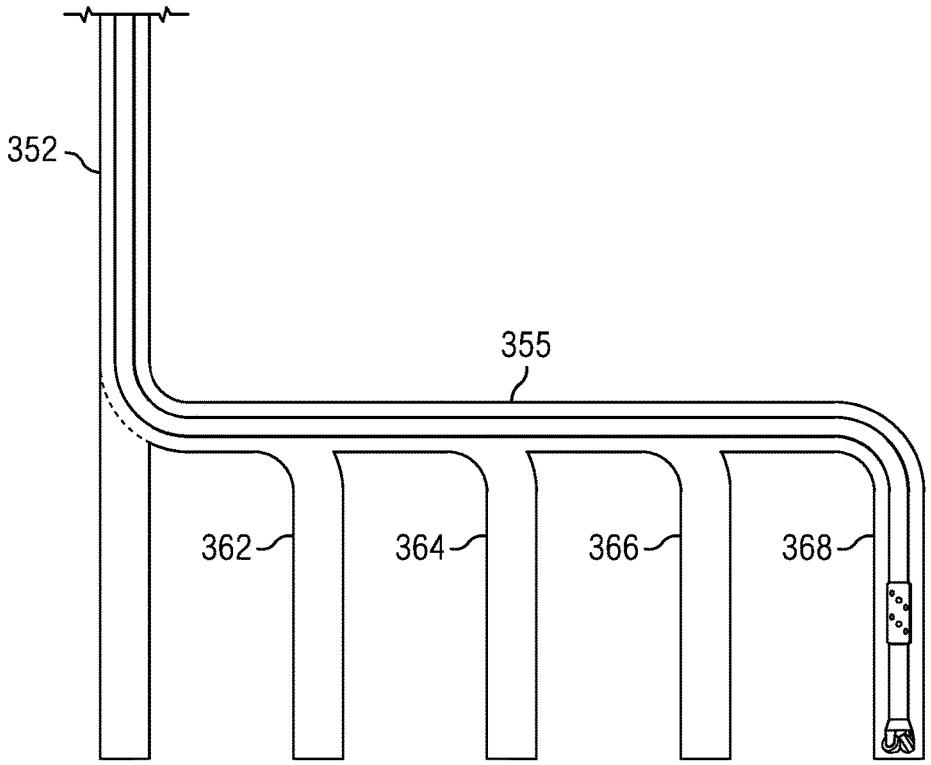
Figure 7D:
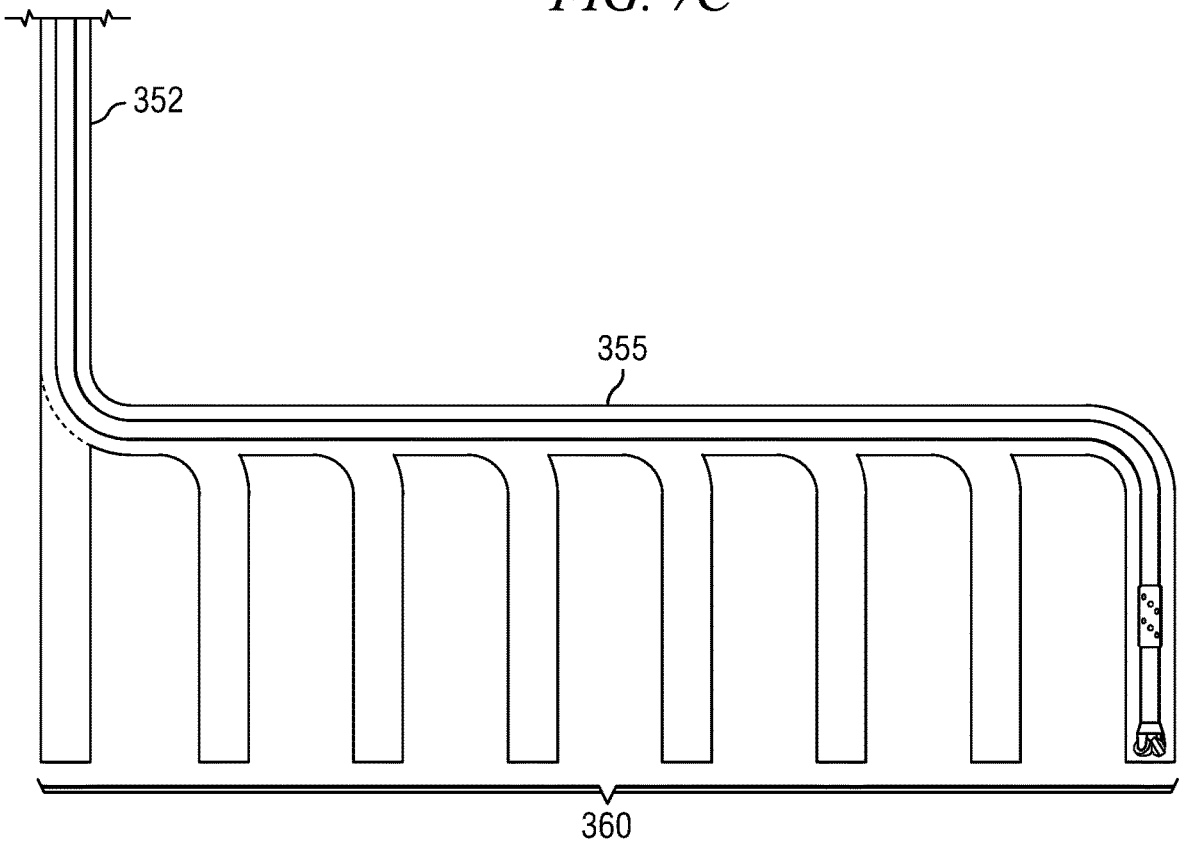

Another alternative embodiment of method 100 (FIG. 4) is depicted on FIGS. 7A-7D. A vertical pilot 352 is drilled into a formation of interest. A short horizontal pilot 355 is sidetracked from the vertical pilot 352 and then steered to form a first vertical sidetrack 362 in FIG. 7A. After the first vertical sidetrack is drilled, the horizontal pilot 355 is extended and a second vertical sidetrack 364 is drilled in FIG. 7B. The horizontal pilot 355 may then be further extended and a third vertical sidetrack 366 drilled and then still further extended and a fourth vertical sidetrack 368 drilled as depicted on FIG. 7C. The operation may continue to form substantially any suitable number of downwardly pointing and/or upwardly pointing vertical sidetracks (FIG. 7D depicts a number of downwardly pointing vertical sidetracks at 360).

With further reference to FIGS. 7A-7D, the vertical sidetracks 360 may be fractured sequentially or simultaneously as described previously. For example, the may be fractured sequentially using a fracturing while drilling tool as described above with respect to FIGS. 5A-5F. The vertical sidetracks may alternatively be fractured using a multi-stage fracturing operation in which they are fractured one by one, in pairs, in triplets, or in any other suitable combination as described above with respect to FIGS. 6A-6C.

Figure 8:
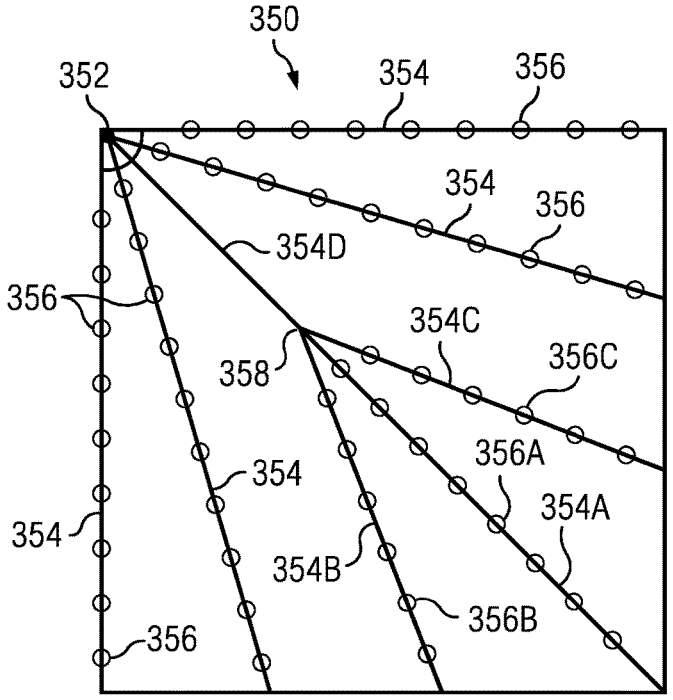
FIG. 8 depicts a plan view of a multilateral wellbore system including a substantially vertical pilot well and a plurality of horizontal pilot wells.

FIG. 8 depicts a plan view of a multilateral wellbore system 350 including a substantially vertical pilot well 352 (shown as a solid circle) and a plurality of horizontal pilot wells (lateral wells) 354. In the depicted embodiment, each of the plurality of horizontal pilot wells 354 may further include a plurality upwardly and/or downwardly pointing vertical sidetracks 356 (shown as open circles on the horizontal pilot wells). Wellbore system 350 may be drilled and fractured using the methodology described above with respect to FIGS. 4, 5A-5F, 6A-6C, and 7A-7D. For example, horizontal pilot well 354A may be drilled along with its corresponding vertical sidetracks 356A. The vertical sidetracks 356A may be hydraulically fractured back to junction 358 using the above-described procedure, for example, as described above with respect to FIGS. 5A-5F or FIGS. 6A-6C. Horizontal pilot well 354A may optionally then be temporarily sealed, for example, using a packer or a cement or gel plug. Horizontal pilot wells 354B and 354C and their corresponding vertical pilot wells 356B and 356C may then be drilled and hydraulically fractured using a similar procedure. Horizontal pilot well 354D and its corresponding vertical pilot wells 356D may then also be drilled and fractured. The other depicted horizontal pilot wells in the system may then be similarly drilled and their vertical pilot wells fractured.

Figure 9:
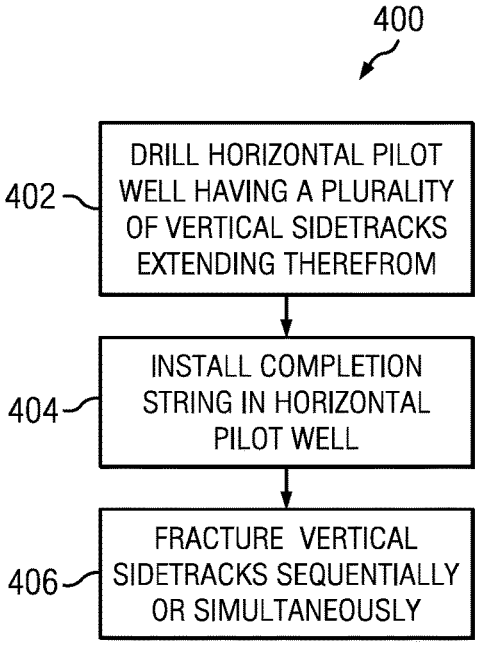
FIG. 9 depicts a flow chart of an alternative method embodiment (which is similar to the method shown on FIG. 4).

FIG. 9 depicts a flow chart of method embodiment 400 (which is similar to method 100 in that it may be used to drill and fracture vertical sidetracks). At 402 a substantially horizontal pilot wellbore having a plurality of vertical sidetracks is drilled. The length of the vertical sidetracks may vary, but may generally be greater than about 25 feet. The vertical sidetracks may be drilled using the same drilling tool that is used to drill the horizontal pilot well, or maybe drilled using a different tool. For example, the vertical sidetracks may be drilled using a coiled tubing drilling system including a drill bit, a mud motor, and a rotary steerable tool capable of achieving a high dogleg (the disclosed embodiments are of course not limited in this regard). One example of a coiled tubing drilling system is disclosed in commonly assigned Patent Publication 2007/0261887, which is incorporated by reference herein in its entirety.

With continued reference to FIG. 9, the horizontal pilot well may be completed at 404. For example, a completion string may be run in and installed in the horizontal pilot well. The completion string may be cemented in place (or partially cemented in place) or used open hole. In one embodiment the completion string may include a plurality of open hole packers for isolating the various vertical sidetracks (e.g., as depicted on FIGS. 6A-6C). The completion string may include fracturing sleeves having ports for fracturing fluid to exit the string. Alternatively, completion of the horizontal pilot well at 404 may include a conventional perforation operation to perforate the completion string at locations adjacent to the vertical sidetracks. The vertical sidetracks may then be fractured (stimulated) at 406 using a multi-stage fracturing operation similar to that described above with respect to FIGS. 6A-6C.

Figure 10:
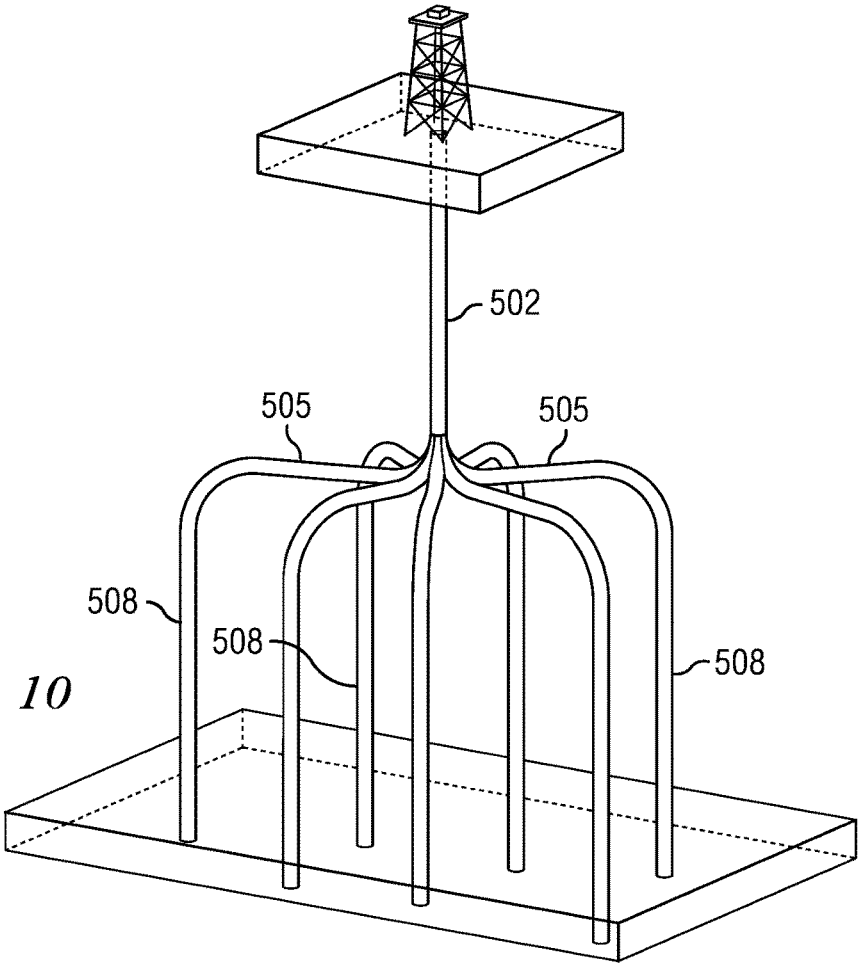
FIG. 10 depicts a schematic illustration an alternative well system employing vertical fracturing.

FIG. 10 depicts an alternative embodiment of a wellbore system including a plurality of fractured vertical sidetracks. In the depicted embodiment, multiple deviated sections 505 are drilled outward from a vertical pilot 502 and steered downward to form a vertical section 508. Such a wellbore system may be formed by first drilling the vertical pilot 502. A deviated section 505 may then be drilled (e.g., sidetracked) from the vertical pilot 502 and steered downward to form the vertical section 508. Each vertical section may be fractured when drilling of that section is complete, for example, using the fracturing while drilling methodology described above.

It will be understood that the embodiment depicted on FIG. 10 may include substantially any number of vertical sections 508. Moreover, each of the deviated sections 505 may include one or more sidetracks from which corresponding vertical sections may be drilled and fractured.

One advantage of the disclosed drilling and fracturing methods is that they may enable significantly improved production and efficiency gains in hydraulic fracturing operations. In particular, the use of the above described vertical sidetracks may significantly improve the efficiency of production, for example, by promoting production from a greater number of sedimentary layers in the formation as postulated above. Drilling these vertical sidetracks from one or more horizontal pilot wells may also enable a significant production increase to be achieved. For example, based on the data compiled in FIG. 2, it may be estimated that each vertical sidetrack is capable of producing about one-third to one-half that of a fully fractured horizontal pilot well having no vertical sidetracks. The production gains may therefore be substantial when a significant number of vertical sidetracks is used. For example, drilling and fracturing 10 vertical sidetracks per horizontal pilot well may result in a three to five fold increase in production volume. Moreover, the disclosed methods enable multilateral well systems to be drilled in which each of the lateral (horizontal) wellbores includes a plurality of vertical sidetracks. Again, this enables significant production magnification.

Although a vertical drilling and fracturing methodology and certain advantages thereof have been described in detail, it should be understood that various changes, substitutions and alternations can be made herein without departing from the spirit and scope of the disclosure as defined by the appended claims.

What is claimed is:

1. A method for drilling and fracturing a subterranean formation, the method comprising:

(a) drilling a substantially horizontal pilot well from a previously drilled vertical pilot well with a drilling apparatus comprising a drill bit;

(b) measuring a direction of maximum formation stress;

(c) drilling a plurality of substantially vertical sidetracks with the drilling apparatus from the horizontal pilot well based at least in part on the measured direction of maximum formation stress, wherein a first substantially vertical sidetrack of the plurality of substantially vertical sidetracks extends from the horizontal pilot well at a different location along the horizontal pilot well than a second substantially vertical sidetrack of the plurality of substantially vertical sidetracks, and wherein each substantially vertical sidetrack includes a wellbore inclination within 30 degrees of true vertical;

(d) pumping fracturing fluid into the plurality of substantially vertical sidetracks to hydraulically fracture the subterranean formation; and (e) hydraulically fracturing the subterranean formation from at least one substantially vertical sidetrack of the plurality of substantially vertical sidetracks.

2. The method of claim 1, wherein at least a subset of the plurality of substantially vertical sidetracks point upwards towards a surface location.

3. The method of claim 1, wherein at least a subset of the plurality of substantially vertical sidetracks point downwards away from a surface location.

4. The method of claim 1, wherein (c) comprises drilling at least five of the substantially vertical sidetracks from the horizontal pilot well.

5. The method of claim 1, wherein:

(a) comprises drilling a plurality of substantially horizontal pilot wells from the previously drilled vertical pilot well; and (c) comprises drilling a plurality of substantially vertical sidetracks from each of the plurality of substantially horizontal pilot wells.

6. The method of claim 1, wherein (a) further comprises:

(i) drilling the previously drilled vertical pilot well; and (ii) drilling the substantially horizontal pilot well from the previously drilled vertical pilot well.

7. The method of claim 1, wherein (c) and (d) comprise at least the following sequential steps:

(i) drilling a first substantially vertical sidetrack from the horizontal pilot well;

(ii) pumping fracturing fluid into the first substantially vertical sidetrack to hydraulically fracture the subterranean formation;

(iii) drilling a second substantially vertical sidetracks from the horizontal pilot well; and (iv) pumping fracturing fluid into the second substantially vertical sidetrack to hydraulically fracture the subterranean formation.

8. The method of claim 1, wherein (c) and (d) comprise first drilling the plurality of substantially vertical sidetracks from the horizontal pilot well and then pumping fracturing fluid into the plurality of substantially vertical sidetracks to hydraulically fracture the subterranean formation.

9. The method of claim 1, wherein (d) further comprises:

(i) deploying a completion string in the horizontal pilot well; and (ii) pumping fracturing fluid through the completion string into the plurality of substantially vertical sidetracks to hydraulically fracture the subterranean formation.

10. The method of claim 9, wherein the completion string comprises a plurality of packers for isolating the plurality of substantially vertical sidetracks from one another.

11. The method of claim 9, wherein the completion string comprises a plurality of corresponding fracturing sleeves deployed adjacent the plurality of substantially vertical sidetracks.

12. The method of claim 9, wherein (i) further comprises:

(ia) cementing the completion string in the horizontal pilot well; and (ib) perforating the completion string at locations adjacent the substantially vertical sidetracks.

13. The method of claim 1, wherein (a) and (c) comprise:

(i) drilling a vertical pilot well;

(ii) drilling a horizontal pilot well from the vertical pilot well;

(iii) steering the horizontal pilot well to form a first substantially vertical sidetrack;

(iv) extending the horizontal pilot well;

(v) steering said extended horizontal pilot well to form another substantially vertical sidetrack; and (vi) repeating (iv) and (v) to form the plurality of substantially vertical sidetracks.

14. The method of claim 13, wherein the plurality of substantially vertical sidetracks are fractured sequentially in (d).

15. The method of claim 13, wherein a subset of the plurality of substantially vertical sidetracks are fractured simultaneously in (d).

16. The method of claim 1, wherein each substantially vertical sidetrack of the plurality of substantially vertical sidetracks extends substantially orthogonally from the horizontal pilot well.

17. The method of claim 1, wherein each substantially vertical sidetrack includes a wellbore inclination within 15 degrees of true vertical.

18. The method of claim 17, wherein each substantially vertical sidetrack includes a wellbore inclination within 10 degrees of true vertical.

19. A method for drilling and fracturing a subterranean formation, the method comprising:

(a) drilling a substantially vertical pilot well with a drilling apparatus comprising a drill bit, (b) measuring a direction of maximum formation stress;

(c) drilling a plurality of deviated wells from the substantially vertical pilot well along the measured direction of maximum formation stress with the drilling apparatus, the deviated wells being turned to form a corresponding plurality of substantially vertical sections in a direction substantially orthogonal to the measured direction of maximum formation stress, wherein a first substantially vertical section of the plurality of substantially vertical sections extends from the respective deviated well at a different location along the respective deviated well than a second substantially vertical section of the plurality of substantially vertical sections, and wherein each substantially vertical section includes a wellbore inclination within 30 degrees of true vertical;

(d) pumping fracturing fluid into the plurality of substantially vertical sections to hydraulically fracture the subterranean formation; and (e) hydraulically fracturing the subterranean formation from at least one deviated well of the plurality of deviated wells.

20. The method of claim 19, wherein:

(c) further comprises drilling a plurality of sidetracks from at least one of the deviated wells, the sidetracks being turned to form a second plurality of substantially vertical sections;

(d) further comprises pumping fracturing fluid into the second plurality of substantially vertical sections to hydraulically fracture the subterranean formation; and (e) further comprises hydraulically fracturing the subterranean formation from at least one substantially vertical section of the plurality of the second plurality of substantially vertical sections.

* * * * *